US005676548A

United States Patent [19]

McAlpin et al.

[11] Patent Number: 5,676,548

[45] Date of Patent: Oct. 14, 1997

[54] APPARATUS FOR TARGET PRACTICE

[76] Inventors: Jim L. McAlpin, P.O. Drawer D, Tupelo, Miss. 38802; Lyndon G. Wilson, 2069 Verona Caney Rd., Lewisburg, Tenn. 37091

[21] Appl. No.: 561,198

[22] Filed: Nov. 21, 1995

[51] Int. Cl.[6] ..... G09B 9/00

[52] U.S. Cl. ..... 434/19; 434/11; 434/16; 273/317

[58] Field of Search ..... 434/11, 16–24; 273/317, 348, 371–374

[56] References Cited

U.S. PATENT DOCUMENTS

| | | | |
|---|---|---|---|
| 2,404,653 | 7/1946 | Plebanek . | |
| 2,710,754 | 6/1955 | Varney . | |
| 2,957,693 | 10/1960 | Ross . | |
| 3,057,622 | 10/1962 | Giannone . | |
| 3,802,098 | 4/1974 | Sampson et al. . | |
| 3,802,099 | 4/1974 | Mell et al. . | |
| 3,849,910 | 11/1974 | Greenly . | |
| 3,914,879 | 10/1975 | Taylor, III et al. . | |
| 4,487,583 | 12/1984 | Brucker et al. . | |
| 4,662,845 | 5/1987 | Gallagher et al. . | |
| 4,934,937 | 6/1990 | Judd . | |
| 4,948,371 | 8/1990 | Hall . | |
| 5,095,433 | 3/1992 | Botarelli et al. | 434/23 |
| 5,194,006 | 3/1993 | Zaenglein | 434/16 |
| 5,215,464 | 6/1993 | Marshall et al. | 434/22 |
| 5,320,358 | 6/1994 | Jones . | |

OTHER PUBLICATIONS

National Semiconductor Corp., *Linear Handbook, LM555/LM555C Timer* (1982), pp. 9–33 through 9–38.

Texas Instruments Corp., The TTL Data Book for Design Engineers. (2d Ed. 1976), pp. 7–72 through 7–80.

*Primary Examiner*—Richard J. Apley

*Assistant Examiner*—Glenn E. Richman

*Attorney, Agent, or Firm*—Walker, McKenzie & Walker, P.C.

[57] ABSTRACT

A target for use in interactive target practice by a shooter firing bullets thereat with a controller for controlling the target's operation. The target includes a target plate, indicators, such as lights, for indicating that a practice round has begun, a target sensor, such as a vibration sensor switch, for detecting when the target plate has been struck by a bullet, and a firing mechanism for firing a projectile, such as a paint ball, at the shooter if the shooter does not hit the target plate within the allotted time. The target plate is hingeably attached to a target stand, a shock absorber is provided for absorbing the impact of bullets upon the target plate, and both the target plate and the target stand are angled forwardly downwardly so as to minimize ricochet of bullets back at the shooter. The controller provides an initial delay for each practice round and then sequences through a series of states, with the progression through the states of the practice round being indicated to the shooter by the indicators on the target. If the shooter does not hit the target within the allotted time for the practice round, then the controller causes a projectile, such as a paint ball, to be fired at the shooter. If the shooter successfully hits the target within the allotted time, then another practice round is begun in which the allotted time for response is decreased.

11 Claims, 4 Drawing Sheets

APPARATUS FOR TARGET PRACTICE

BACKGROUND OF THE INVENTION

1. Field of the Invention

The present invention relates, in general, to apparatus for training in the use of firearms, and in particular, to apparatus for use in firearms target practice so as to test and improve the reaction time of a shooter.

2. Information Disclosure Statement

Military and/or police personnel are routinely faced with life-threatening situations in combat or while on routine patrol. To ensure that the military and/or police personnel will be able to react quickly in such a situation and maim or kill a hostile opponent, target practice is often used in training such personnel to be able to shoot their weapons accurately.

However, standard target practice does not test or improve the reaction times of a shooter, nor does it give a sense of urgency to the shooter's response because a traditional target, unlike an actual hostile opponent, does not respond and fire back at the shooter if the shooter's response is too slow.

Many games and the like are known that allow a game player to fire a light gun at an electric eye of a target, and the game player's reaction time can be thus measured. However, such games do not present the same training situation as the firing of a true large caliber weapon by the shooter. Additionally, numerous issues arise when large caliber weapons are used in target practice, such as, for example, the danger of ricocheting of bullets back from the target toward the shooter and the extreme abuse to which any target is subjected by the impact of large caliber bullets.

It is therefore desirable to have an apparatus for use in interactive target practice by a shooter firing live munition such as large caliber bullets. Such an apparatus should test and improve the reaction time of the shooter, firing projectiles (such as paint balls and the like) back at the shooter if the shooter's reaction time is too slow in hitting the target during a practice round, and the permitted allowable reaction time should decrease with successive practice rounds. Any such target should also maximize safety to the shooter by minimizing the danger of ricocheting bullets back toward the shooter.

A preliminary patentability search for the present invention produced the following patents, some of which may be relevant to the present invention: Plebanek, U.S. Pat. No. 2,404,653, issued Jul. 23, 1946; Varney, U.S. Pat. No. 2,710,754, issued Jun. 14, 1955; Ross, U.S. Pat. No. 2,957,693, issued Oct. 25, 1960; Giannone, U.S. Pat. No. 3,057,622, issued Oct. 9, 1962; Sampson et al., U.S. Pat. No. 3,802,098, issued Apr. 9, 1974; Mell et al., U.S. Pat. No. 3,802,099, issued Apr. 9, 1974; Greenly, U.S. Pat. No. 3,849,910, issued Nov. 26, 1974; Taylor, III et al., U.S. Pat. No. 3,914,879, issued Oct. 28, 1975; Brucker et al., U.S. Pat. No. 4,487,583, issued Dec. 11, 1984; Gallagher et al., U.S. Pat. No. 4,662,845, issued May. 5, 1987; Judd, U.S. Pat. No. 4,934,937, issued Jun. 19, 1990; Hall, U.S. Pat. No. 4,948,371, issued Aug. 14, 1990; and Jones, U.S. Pat. No. 5,320,358, issued Jun. 14, 1994.

Additionally, applicants are also aware of the following references: National Semiconductor Corp., Linear Handbook (1982), which, at pages 9–33through 9–38, describes a LM555/LM555C timer and suggested configurations therefor; and Texas Instruments Inc., The TTL Data Book for Design Engineers (2d Ed. 1976), which, at pages 7–72 through 7–80, describes a SN7493 binary counter. None of these references, either singly or in combination, disclose or suggest the present invention.

SUMMARY OF THE INVENTION

The present invention is a target for use in interactive target practice by a shooter firing bullets thereat and control means for controlling the operation of the target. The target includes a target plate, indicator means, such as lights, for indicating to the shooter that a practice round has begun, target sensor means, such as a vibration sensor switch, for detecting when the target plate has been struck by a bullet fired by the shooter, and firing means for firing a projectile, such as a paint ball, at the shooter if the shooter does not hit the target plate within the allotted time. The target plate is hingeably attached to a target stand, shock absorbing means are provided for absorbing the impact of bullets upon the target plate, and both the target plate and the target stand are angled forwardly downwardly so as to minimize ricochet of bullets back at the shooter.

The control means provides an initial delay for each practice round and then sequences through a series of states, with the progression through the states of each practice round being indicated to the shooter by the indicator means on the target. If the shooter does not hit the target within the allotted time for the practice round, then the control means causes a projectile, such as a paint ball, to be fired at the shooter. If the shooter successfully hits the target within the allotted time for the practice round, then another practice round is begun in which the allotted time for response is decreased.

It is an object of the present invention to provide an apparatus for use in interactive target practice by a shooter firing live ammunition such as large caliber bullets. A further object is to present the shooter with increasing difficulty challenges by reducing the permitted reaction time with each practice round. A still further object is to maximize safety to the shooter by minimizing the danger of ricocheting bullets back toward the shooter.

DESCRIPTION OF THE PREFERRED EMBODIMENT

Figure 1:
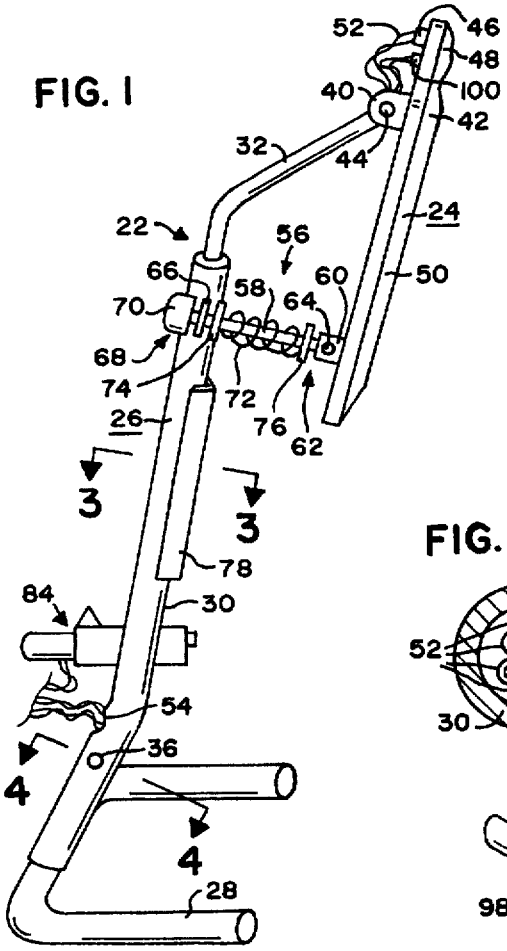
FIG. 1 is a perspective side view of the target of the present invention mounted upon its target stand.
Figure 2:
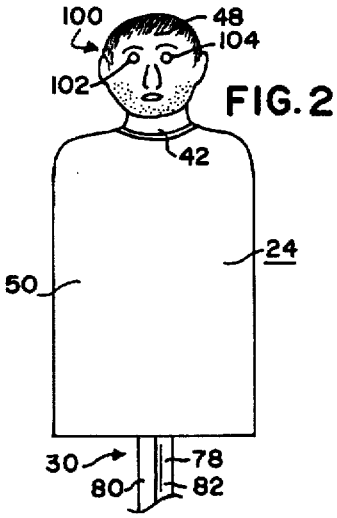
FIG. 2 is a front view of the target plate of the present invention.
Figure 3:
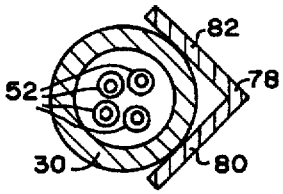
FIG. 3 is a partial sectional view of the target stand of the present invention, taken substantially along the line 3—3 shown in FIG. 1, showing the angled deflection shield.
Figure 4:
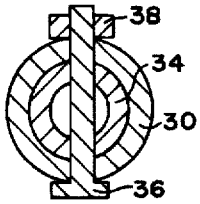
FIG. 4 is a partial sectional view of the target stand of the present invention, taken substantially along the line 4—4 shown in FIG. 1, showing the mating of the various pieces of the target stand.

FIGS. 1–5 show the structure of the target 22 of the present invention. Target 22 includes a target plate 24, preferably constructed of ⅝ inch (1.6 cm) steel plate fashioned in the shape of an upper body portion of a human torso, preferably 22 inches (56 cm.) high and 11.25 inches (28.6 cm.) wide, preferably having a painted face resembling a hostile opponent such as a criminal or a member of an opposing army. It is important that the target plate 24 be constructed of thick steel plate so as to withstand the impact of large-caliber bullets thereupon.

Target 22 further includes a target stand 26 for supporting the considerable weight of target plate 24. Target stand 26 has a generally U-shaped base 28 formed of 3 inch (7.6 cm) diameter galvanized pipe tubing and an upwardly-extending and forwardly (downwardly from vertical) angled upright member 30 formed of 2.5 inch (6.35 cm) galvanized pipe tubing with an uppermost portion 32 formed of 1.75 inch (4.4 cm) galvanized pipe tubing. Base 28 has an upwardly-extending pipe 34 welded thereto that supports and is closely received within upright member 30 of stand 26 (see FIG. 4), and pipe 34 and upright member 30 are secured together for easy disassembly as by a well-known pin or bolt 36 and nut 38.

Target plate 24 is hingeably attached to uppermost portion 32 of stand 26 as by hinge means such as a yoke 40 extending perpendicularly rearwardly from target plate 24 at about the shoulder or collarbone portion 42 of target plate 24, and yoke 40 is hingeably attached to uppermost portion 32 of stand 26 as by a pin or bolt 44 through uppermost portion 32 in a manner that will now be apparent. Preferably, and for greatest simulation of reality, the height of the top of target plate 24 is approximately 5 feet 9 inches (1.75 meters) above the ground, a typical height for a hostile opponent.

Target 22 also includes target sensor means 46, such as a well-known normally-closed vibration sensor switch, for detecting when target plate 24 has been struck by a bullet fired by a shooter. Preferably, target sensor means 46 is securely mounted on the rear side of target plate 24 behind the forehead portion 48 of the target so as to allow vibrations of target plate 24 to be communicated to sensor means 46 while placing sensor means 46 out of the main body portion 50 of target plate 24 so as to avoid the severe impact vibrations of bullet impact, and also to allow wires 52 to sensor means 46 to enter the open end of pipe 32 and be threaded down through pipe 32 and pipe 30, emerging at a lower hole 54 in pipe 30, thereby protecting wires 52 from breakage by bullets. Additionally, such a mounting of sensor means 46 prevents contact and subsequent breakage of sensor means 46 by pipe 30 when target plate 24 hingeably swings back and forth, in a manner hereinafter described.

Because the present invention is intended for use with large caliber ammunition so as to best simulate true firing situations, the impact energy of such bullets upon target plate 24 can be substantial. Therefore, target 22 additionally preferably comprises shock absorbing means 56, interposed between target stand 26 and target plate 24, for absorbing the impact energy of bullets striking target plate 24. In the preferred embodiment, shock absorbing means 56 includes a 6.5 inch (16.5 cm) long, ½ inch (1.3 cm) diameter pipe 58, hingeably attached to target plate 24 as by a yoke 60 extending perpendicularly rearwardly from target plate 24 remote from hinge means 40, with a first end 62 of pipe 58 being hingeably entrapped within yoke 60 as by a pin or bolt 64. Slidably securing pipe 58 to upright member 30 is a well-known "eye bolt" 66 that is weldedly secured to pipe 30 so as to extend sidewardly and radially outward from pipe 30 with the opening of eye bolt 66 aligned with the longitudinal axis of pipe 58. The second end 68 of pipe 58 extends slidably through the opening of eye bolt 66 and a pipe cap 70, secured to second end 68 of pipe 58, retains pipe 58 within eye bolt 66 and holds target plate 24 angled downwardly toward the shooter for reasons hereinafter described.

Surrounding pipe 58 between its first and second ends 62, 68 and interposed between eye bolt 66 and target plate 24 is a compression spring 72 with large washers 74, 76 at either end of spring 72 and encircling pipe 58 so as to provide opposing surfaces for the ends of spring 72, with washers 74, 76 preferably having a 1 inch (2.54 cm) outer diameter and a ¾ inch (1.9 cm) inner diameter. As bullets strike plate 24, the plate hingeably swings rearwardly, compressing entrapped compression spring 72 between eye bolt 66 and plate 24 by washers 74, 76 as pipe 58 slides rearwardly through eye bolt 66, thereby absorbing the energy of the impacting bullets.

For safety, target 22 is constructed so that no substantially vertical surfaces of target 22 are facing the shooter, thereby reducing the danger of ricocheting bullets rebounding toward the shooter. Upright member 30 of target stand 26 is seen to angle downwardly from vertical (forwardly) toward the shooter, who, of course, stands a distance in front of target plate 24. Target plate 24 is also angled downwardly from vertical (forwardly) toward the shooter about the axis of hinge means 40, being prevented from achieving full hinged movement to vertical when cap 70 rests against eye bolt 66 as pipe 8 slides therethrough in a manner heretofore described.

For additional safety, target stand 26 further preferably includes a deflection shield 78 weldedly secured to an exposed portion of upright pipe member 30, with deflection shield 78 having left 80 and right 82 deflection plates, each sidewardly angled so that impinging bullets from the shooter are deflected sidewardly (and also downwardly, due to the downward and forward angle of upright pipe member 30) and not back at the shooter. Deflection shield 78 is preferably constructed of a piece of well-known 1.5 inch (3.8 cm.) angle iron bracket with left and right deflection plates 80, 82 being perpendicular to each other as shown.

Figure 5:
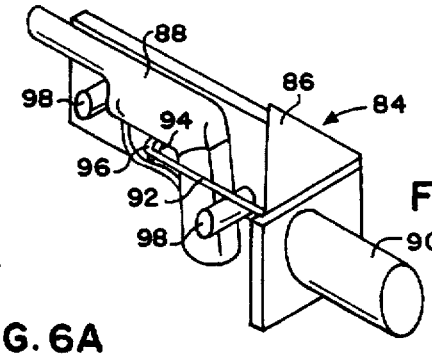
FIG. 5 is a perspective view of the firing means of the present invention.

Target 22 further includes firing means 84 for firing a projectile at the shooter. Referring especially to FIG. 5, firing means 84 includes a frame 86 for holding a projectile gun 88, such as, for example, a well-known so-called "paint ball gun" for firing paint balls or else gun 88 may be a standard revolver fitted, in a manner well-known to those skilled in the art, with plastic bushings so as to enable the firing of paint ball "bullets", and firing means 84 also includes an electrically-actuated solenoid 90 mounted to frame 86. Solenoid 90, when actuated, reciprocates arm 92 toward solenoid 90, thereby causing the trigger 94 of gun 88 to be pulled by a hook 96 at the remote end of arm 92, and hook 96 is thus understood to engage and be mechanically coupled to trigger 94. Gun 88 may preferably rest upon and against one or more supporting pegs 98 of frame 86, and it shall be understood that gun 88 is securely lashed into frame 86 by various ties or straps, not shown, in a manner well-known to those skilled in the art.

Target 22 still further includes indicator means 100, hereinafter described in greater detail, for indicating to the shooter that a practice round has begun. Indicator means 100 preferably comprises first and second indicator lights 102 and 104, respectively mounted to target plate 24 through transverse holes therethrough and respectively positioned on target plate 24 as the right and left eyes of the hostile opponent.

Referring now to FIGS. 7, 8A, 8B, and 8C, the apparatus of the present invention is seen to further comprise control means 120 for controlling the operation of target 22. As hereinafter described in detail, control means 120 includes: manual activate means 122 for initiating a repetition series of practice rounds for the shooter; delay means 124, operably triggered by activate means 122 and by target sensor means 46, for delaying the start of each practice round by a given delay; target sequence means 126 for sequencing target 22 through a series of states for each practice round; timing means 128 for causing target sequence means 126 to sequence through its series of states at a given rate after the given delay; repetition series sequence means 130 for counting the practice rounds; and timing speed control means 132, operably coupled to repetition series sequence means 130 and responsive thereto, for changing the given rate of timing means 128 on successive practice rounds.

Additionally, there may be provided power supply means 134 for supplying power to control means 120 as by providing various regulated voltages in a manner hereinafter described. Unless otherwise noted hereinbelow, all resistors used in the circuitry of the present invention are preferably ½ watt and all electrolytic capacitors are preferably of a 16 volt or greater rating.

Turning first to power supply means 134, a well-known power source, preferably such as 12.6 volt direct current battery 136, is connected at the input of power supply means 134. Although an appropriate well-known power supply source could be used to replace battery 136 and convert, for example, 110 volt alternating current to 12.6 volts direct current for input to power supply means 134, the use of battery 136 provides portability of the present invention for use outdoors on firing ranges where alternating current may not be available. A well-known single-pole single-throw on-off power switch 138 is included in series with battery 136 for selectively applying and removing power to control means 120, and a 3 ampere diode 140, preferably a well-known 1N3401 diode, is provided as reverse polarity protection for the circuitry of power supply means 134 and control means 120 in case battery 136 should happen to be misconnected to power supply means 134 with reverse polarity. A 1000 microfarad electrolytic capacitor 142 filters the 12 volt DC voltage supplied to control means 120.

Zener diode 144, a well-known 5.1 volt 1N4733 zener diode, together with NPN transistor 146, a well-known TIP-31 transistor; diode 148, a well-known 1N4001 diode (provided to bootstrap the base of transistor 146 by a diode drop above zener diode 144, thus substantially matching the base to emitter drop across transistor 146); resistor 150, a 220 ohm, 1 watt resistor; and resistor 152, a 1.2 K ohm resistor, together create a regulated 5 volt DC supply for control means 120 in a manner well-known to those skilled in the art. Silicon-controlled rectifier ("SCR" ) 154, a well-known C-106B SCR, is provided to shut down the regulated 5 volt supply when the signal "5VKILL" of node 156 is asserted high in a manner hereinafter described, and, when the signal 5VKILL is applied to the gate of SCR 154 through 180 ohm resistor 158, thus firing SCR 154, transistor 146 is caused to shut down the regulated 5 volt supply in a manner now understood by those skilled in the art. A low-pass filter, formed by 470 ohm resistor 160 in parallel with 1000 microfarad electrolytic capacitor 162, stabilizes the 5 volt DC output of power supply means 134, and light emitting diode ("LED") 166, connected to the 5 volt supply by 180 ohm resistor 164, provides a "System Ready" visual indicator to the operator that the 5 volt supply is operating.

Figure 8A:
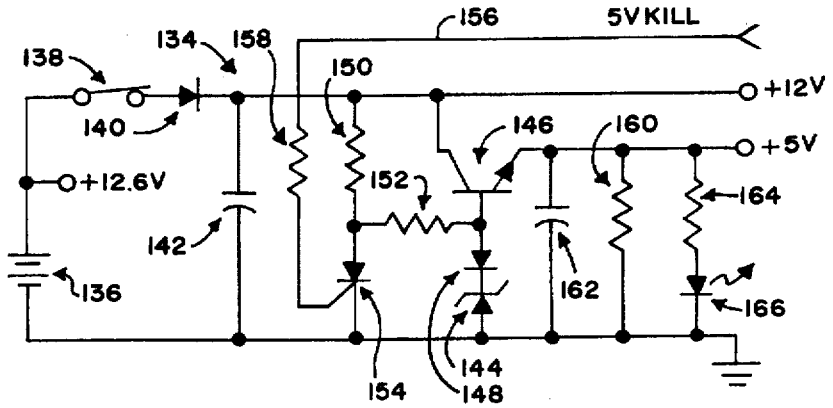
FIGS. 8A, 8B, and 8C are respectively the leftmost, middle, and rightmost portions of a schematic diagram of the electronic components of the control means of the present invention.
Figure 8B:
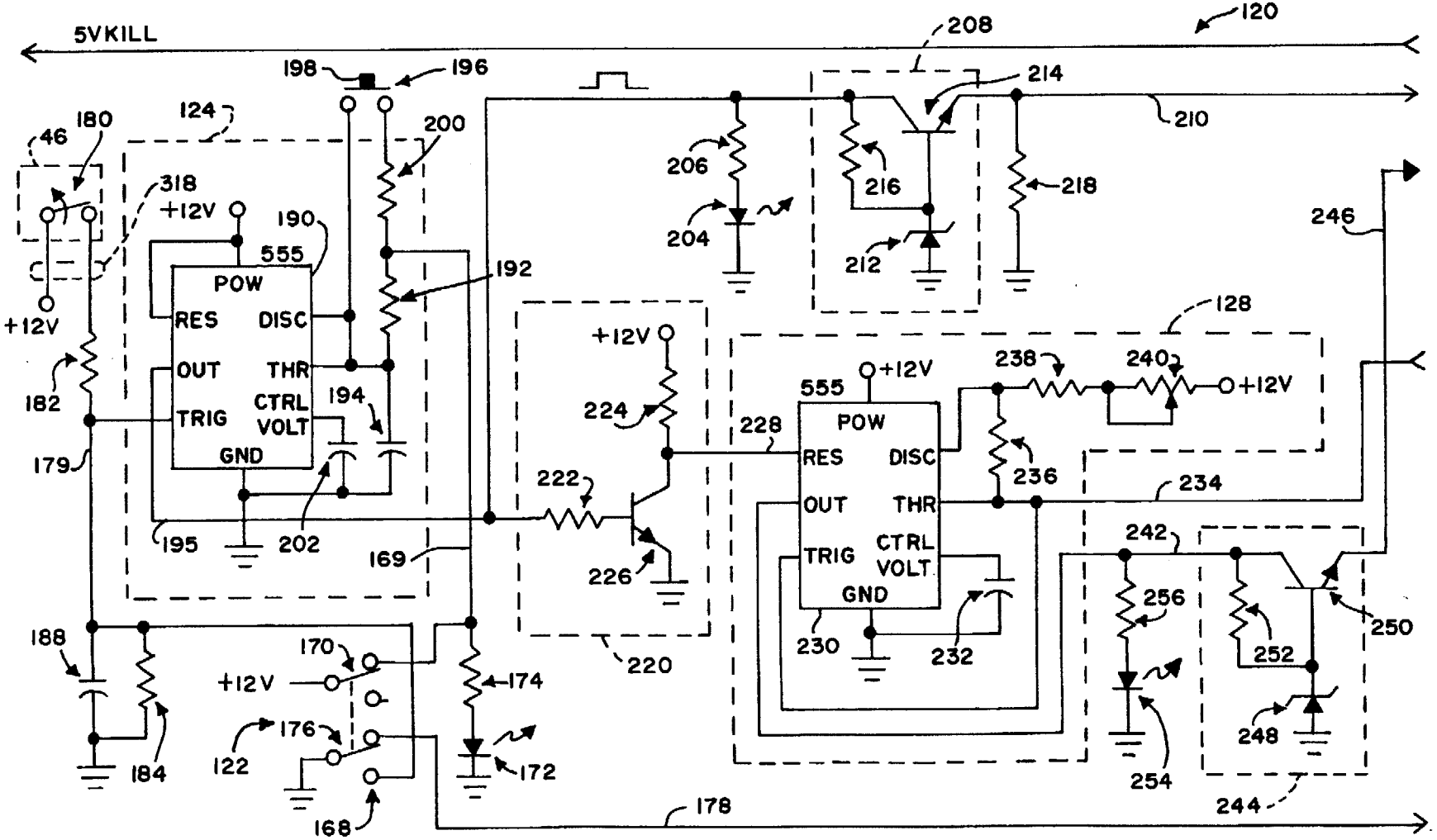
Figure 8C:
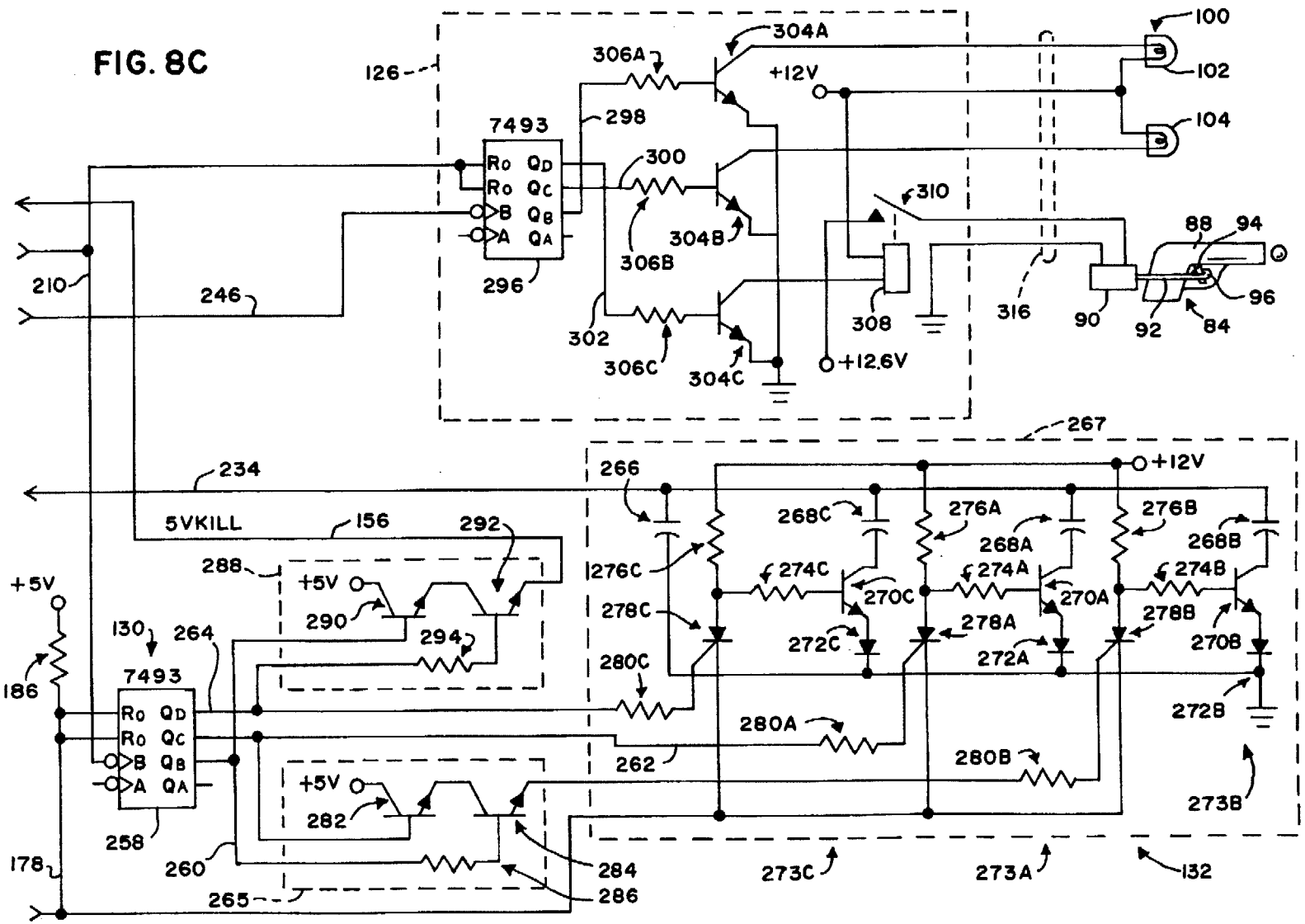

Activate means 122 is preferably a well-known double-pole double-throw ("DPDT") switch 168. When in the upward (or "System Active") position as shown in FIG. 8B, 12 volts DC is applied as a charging voltage on node 169 to delay means 124 by the first half 170 of switch 168, thereby activating delay means 124, and 12 volts DC also is applied to "System Active" LED 172 through 470 ohm resistor 174 so as to give a visual indication to the operator that control means 120 is actively operating. When, instead, switch 168 is placed in the downward (or "System Inactive") position, no charging voltage is applied on node 169 to delay means 124, thereby shutting down delay means 124 and also causing System Active LED 172 to not be illuminated.

The second half 176 of switch 168, when in the upward or System Active position as shown in FIG. 8B, grounds reset node 178 to repetition series sequence means 130 and to timing speed control means 132 for reasons hereinafter given. Also, when switch 168 is in the upward or System Active position, the trigger input 179 to delay means 124 is pulled high to approximately 4.5 volts through well-known normally-closed vibration sensor switch 180 of target sensor means 46 and through 2K ohm resistor 182, acting together with 1.2K ohm resistor 84 as a resistive divider. When, instead, switch 168 is placed in the downward or System Inactive position, the trigger input to delay means 124 is grounded, thus inhibiting triggering of delay means 124 and allowing reset node 178 to be pulled up to 5 volts by 2K ohm resistor 186. A 10 microfarad electrolytic capacitor 188 acts to eliminate false triggering of delay means 124.

Delay means 124 has, at its heart, a well-known 555 timer integrated circuit 190, interconnected so as to create a monostable one-shot having a timing constant determined by 3.3K ohm resistor 192 and 2200 microfarad electrolytic capacitor 194, selectively charging toward 12 volts supplied by node 169 when switch 168 is placed in the System Active (upward) position. With these preferred values, delay means 124 provides an approximately eight-second delay at output node 195 from the triggering of timer 190 at node 179. Delay means 124 preferably includes delay abort means 196, such as a normally-open "Delay Abort" pushbutton 198, for manually selectively surprisingly terminating the delay time of delay means 124 during any given practice round. Such a delay abort means is useful in forcing a shooter to remain alert when, for instance, the operator suspects that a shooter is becoming inattentive or that the shooter is beginning to anticipate the delay of delay means 124. Delay abort pushbutton 198, when closed, places 180 ohm resistor 200 in parallel with resistor 192, thereby causing the effective paralleled resistance to be about 171 ohms, thus severely reducing the delay time constant of delay means 124 by a factor just over 19, thereby effectively aborting any in-progress delay almost immediately. Bypass capacitor 202, a 0.01 microfarad capacitor, is provided to ground from the control voltage pin of timer 190, thereby increasing the noise immunity of timer 190 in a manner well-known to those skilled in the art.

When system active/inactive switch 168 is switched from "inactive" to the "active" position shown in FIG. 8B, trigger input node 179 to timer 190 is released from ground and begins rising toward approximately 4.5 volts as capacitor 188 charges through normally closed vibration switch 180, and, simultaneously, capacitor 194 begins charging through resistor 192 from node 169. After the initial eight-second delay, output node 195 drops, thereby enabling timing means 128 and sequencing repetition series sequence means 130 in a manner hereinafter described in detail. When vibration switch 180 opens in response to a bullet striking upon target plate 24, trigger node 179 fails below 4 volts, the trigger threshold of timer 190, as capacitor 188 is discharged through resistor 184, thereby retriggering timer 190 to begin another delay period, thereby starting another practice round.

The output of timer 190, seen on node 195, is applied to "Set Pulse" indicator LED 204 through resistor 206 for monitoring the eight second "set delay" on the front operator's panel. In order to drive the TTL logic inputs of repetition series sequence means 130 and target sequence means 126, a logic level converter 208 converts the 12 volt delay means output signal on node 195 into a 5 volt TTL signal on node 210 using 5.1 volt 1N4753 zener diode 212, TIP-31 NPN transistor 214, and 470 ohm resistors 216 and 218. Similarly, inverter 220, created from 1.2K ohm resistor 222, 10K ohm resistor 224, and 2N2222 NPN transistor 226, drives the reset (enable) input 228 of timing means 128, thereby inhibiting timing means 128 during the initial eight second delay from delay means 124.

The heart of timing means 128 is a well-known 555 timer integrated circuit 230, interconnected as an astable multivibrator that creates pulses at a given rate once the timer 230 is enabled. Bypass capacitor 232, a 0.01 microfarad capacitor, is provided to ground from the control voltage pin of timer 230, thereby increasing the noise immunity of timer 230 in a manner well-known to those skilled in the art. The capacitance portion of the time constant for timer 230, i.e., the capacitance to ground from node 234, is variably provided by timing speed control means 132 in a manner hereinafter described, thereby allowing the given rate for timing means 128 to be changed. The two resistive components (so-called "$R_B$" and "$R_A$" resistors) of the time constant for timer 230 are provided by 3.3K ohm resistor 236 (across the "discharge" and "threshold" pins of timer 230) and the series combination of 5.1K ohm resistor 238 with 10K ohm potentiometer 240, with potentiometer 240 thus providing an overall manual "Speed Adjust" control for the rate of timing means 128. The output of timer 230, on node 242, is converted through a logic level converter 244 into a suitable TTL level signal on node 246 for the clock input of target sequence means 126, with logic level converter 244 using a 5.1 volt 1N4753 zener diode 248, a TIP-31 NPN transistor 250, and a 470 ohm resistor 252 to perform the 12 volt to 5 volt logic conversion. The output pulses from timer 230 are monitored for troubleshooting purposes by "Draw Pulse" LED 254 through 470 ohm resistor 256 from timer output node 242.

When node 228 is low, as is the case during the initial eight second delay of delay means 124, timing means 128 is inhibited from generating clock pulses to target sequence means 126.

Repetition series sequence means 130 is implemented using a well-known SN7493 binary counter 258 configured as a three bit counter, and the three bits of its state information, i.e., least significant bit ("LSB") 260, second most significant bit ("2MSB") 262, and most significant bit ("MSB") 264, are fed to timing speed control means 132 so as to cause the time constant for timing means 128 to change with successive rounds in each repetition series of practice rounds. When "System Active/inactive" switch 168 is placed in the inactive or downward position, 2K ohm pullup resistor 186 on reset node 178 causes counter 258 to reset to a count of 000. When switch 168 is placed in the active or upward position, reset node 178 is grounded, thus inhibiting reset of counter 258 and enabling counts on each high to low transition on node 210, i.e., at the end of each eight second delay period of delay means 124. Counter 258 is thus seen to have a value of 000 during the initial delay before the first practice round, and then has a value of 001 (binary) during the first practice round while timing means 128 is enabled, and this value increases to 010, 011, 100, and 101 (binary) at the end of successive delay periods from delay means 124, thereby counting the succession of practice rounds.

Timing speed control means 132 comprises logical "AND" gate 265 and variable capacitance means 267, both operably coupled to the three counter bits of repetition series sequence means 130 and responsive thereto, so as to change the given rate of timing means 128 on successive practice rounds. Capacitor 266, a 33 microfarad electrolytic capacitor, is seen to be always connected from node 234 to ground, whereas capacitors 268A, 268B, and 268C, each respectively also 33 microfarad electrolytic capacitors, are selectively connected to ground through NPN 2N2222 transistors 270A, 270B, and 270C, respectively, and 1N4001 diodes 272A, 272B, and 272C, respectively, in a manner hereinafter described, thereby allowing the effective capacitance to ground from node 234 to vary, thereby changing the given rate of timing means 128. Each of capacitor switching sections 273A, 273B, and 273C is substantially the same, each additionally having respective 1.2K ohm base resistors 274A, 274B, and 274C, respective 180 ohm current supply resistors 276A, 27611, and 276C, respective well-known C-106B silicon controlled rectifiers ("SCRs") 278A, 27811, and 278C, and respective 180 ohm gate resistors 280A, 280B, and 280C feeding the respective gates of each SCR. A description of the operation of capacitor switching section 273A will suffice for all three sections, each section being understood to have similar reference numerals for its components but with different appended suffixes, e.g., "A", "B", or "C".

Initially, SCR 278A is not fired, causing resistor 276A to pull the base of transistor 270A up through base resistor 274A, thereby placing transistor 270A into saturation and connecting capacitor 268A from node 234 to ground, thereby increasing the capacitance from node 234 to ground. When the leftmost leg of gate resistor 280A is driven high by the second most significant bit ("2MSB") of counter 258, SCR 278A fires, thereby creating a current path through SCR 278A to node 178, which is held at ground because switch 168 must be in the upward or "system active" position for counter 258 to be not reset to zero. This current path through SCR 278A to ground thus places transistor 270A into cutoff, thereby removing capacitor 268A from its connection between node 234 and ground, thereby decreasing the capacitance from node 234 to ground, thereby increasing the rate of timing means 128. SCR 278A, once fired, will continue conducting even as counter 258 changes state until switch 168 is returned to the "system inactive" position, thereby resetting counter 258 to zero and also raising node 178 high through pullup resistor 186, thereby shutting off SCR 278A and returning transistor 270A to saturation and reconnecting capacitor 268A to ground.

It will be now understood that all three capacitors 268A, 268B, and 268C are initially connected in parallel across capacitor 266, thereby quadrupling the capacitance of capacitor 266, and, as each of SCRs 278A, 278B, and 278C sequentially fire as hereinafter described and as caused by appropriate states of counter 258, capacitors 268A, 268B, and 268C are sequentially removed from being in parallel with capacitor 266, thereby decreasing the time constant for timing means 128 and thereby increasing its given rate. Of course, by appropriate variation of capacitors 268A, 268B, or 268C, the changing of the given rate of timing means 128 can be appropriately regulated as desired.

The decoding of the states of counter 258 is aided by discrete "AND" gate 265, comprising 2N2222 NPN transistors 282 and 284 and 5.1K ohm resistor 286, such that the output at the emitter of transistor 284 goes high when counter 258 has a value of 011 (binary). When counter 258 is either in its initial state of 000 (binary) or in its first state of 001 (binary), none of SCRs 278A, 278B, or 278C are fired, thereby connecting capacitors 268A, 268B, and 268C in parallel across capacitor 266. When counter 258 reaches a state of 010 (binary), SCR 278A fires, in a manner heretofore described, thereby removing capacitor 268A from across capacitor 266. When counter 258 reaches a state of 011 (binary), SCR 278B similarly fires, caused by the decoding of that state by AND gate 265, thereby removing capacitor 268B from across capacitor 266. When counter 258 reaches a state of 100 (binary), its most significant bit, on node 264, causes SCR 278C to fire, thereby removing capacitor 268C from across capacitor 266.

When counter 258 reaches its next state of 101 (binary), indicating that four successful rounds have been completed in which the shooter successfully hit the target within the allotted response time, discrete logic AND gate 288 decodes the state 101 (binary) and asserts the signal 5VKILL high on node 156, thereby shutting down the 5 volt supply and disabling control means 120 until the power switch 138 is switched off and then on again. Like AND gate 265, AND gate 288 comprises 2N2222 NPN transistors 290 and 292 and 5.1K ohm resistor 294.

Target sequence means 126 has, at its heart, a well-known SN7493 binary counter 296 configured as a three bit counter, and the three bits of its state information, i.e., least significant bit ("LSB") 298, second most significant bit ("2MSB") 300, and most significant bit ("MSB") 302, are used to cause various actions as given in Table I, below, and as explained in detail hereinbelow.

TABLE I

TARGET SEQUENCE MEANS STATE TABLE

| STATE | ACTION |
|---|---|
| 000 | none |
| 001 | illuminate right eye |
| 010 | illuminate left eye |
| 011 | illuminate both eyes |
| 100 | fire paint ball gun |

State 000 (binary) is the initial state of counter 296, entered when reset node 210 is driven high during the eight-second delay that precedes each practice round, thereby resetting counter 296 to the "all zero" state. The sequencing of state transitions from one to another through the series of states occurs with the falling (trailing) edge of each pulse from timing means 128 on node 246.

State 001 (binary) is a first intermediate state, following initial state 000, indicating that the practice round has begun by actuating indicator means 100, and preferably providing this indication by illuminating first indicator light 102 in a manner hereinafter described. Preferably, first indicator light 102 is positioned as the "right eye" of the hostile opponent depicted on target plate 24, as heretofore described.

State 010 (binary) is a second intermediate state, following first intermediate state 001, signifying that the practice round is progressing and that firing means 84 will soon be actuated and preferably providing this indication by illuminating second indicator light 104 in a manner hereinafter described. Preferably, second indicator light 104 is positioned as the "left eye" of the hostile opponent depicted on target plate 24, as heretofore described.

State 011 (binary) is a third intermediate state, following second intermediate state 010, signifying the practice round is further progressing and is almost over and that firing means 84 is poised for imminent firing. This indication is preferably provided by illuminating both first and second indicator lights 102 and 104, i.e., turning on both eyes of the hostile opponent.

State 100 (binary) is a firing state, selectively following the preceding states, signifying that the shooter has not struck the target plate by a bullet during the practice round, and firing state 100 causes the actuation of firing means 84 in a manner hereinafter described, thereby firing a projectile, such as a paint ball, at the shooter and indicating failure to successfully hit the target plate with a bullet during the allotted time.

Each time the shooter successfully hits the target plate 24 during a practice round, delay means 124 is retriggered by vibration sensor 180, thereby starting a new delay period, resetting counter 296 to its initial state and beginning a new practice round in the sequence.

Each of the state bits 298, 300, and 302 of counter 296 is passed to respective well-known TIP-120 NPN driver transistors 304A, 304B, and 304C through respective 33 ohm base resistors 306A, 306B, and 306C, thereby providing sufficient current drive capability, when the respective driver transistor is in saturation, to respectively actuate first indicator light 102 (right eye), second indicator light 104 (left eye), and relay coil 308. Relay coil 308, when energized, closes normally-open contacts 310, thereby supplying 12.6 volts DC to firing means solenoid 90, thereby actuating arm 92 and pulling trigger 94 of paint ball gun 88, thereby firing a paint ball at the tardy shooter.

Figure 6A:
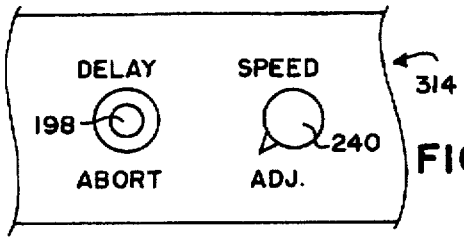
FIG. 6A is a view of a portion of the rear operator's panel of the control means of the present invention.
Figure 6:
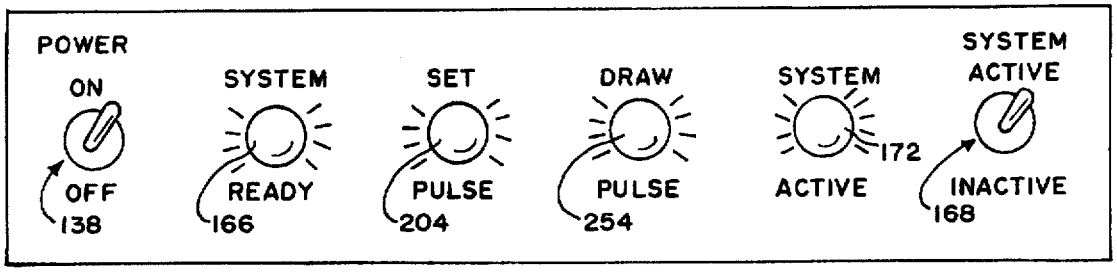
FIG. 6 is a view of the front operator's panel of the control means of the present invention.
Figure 7:
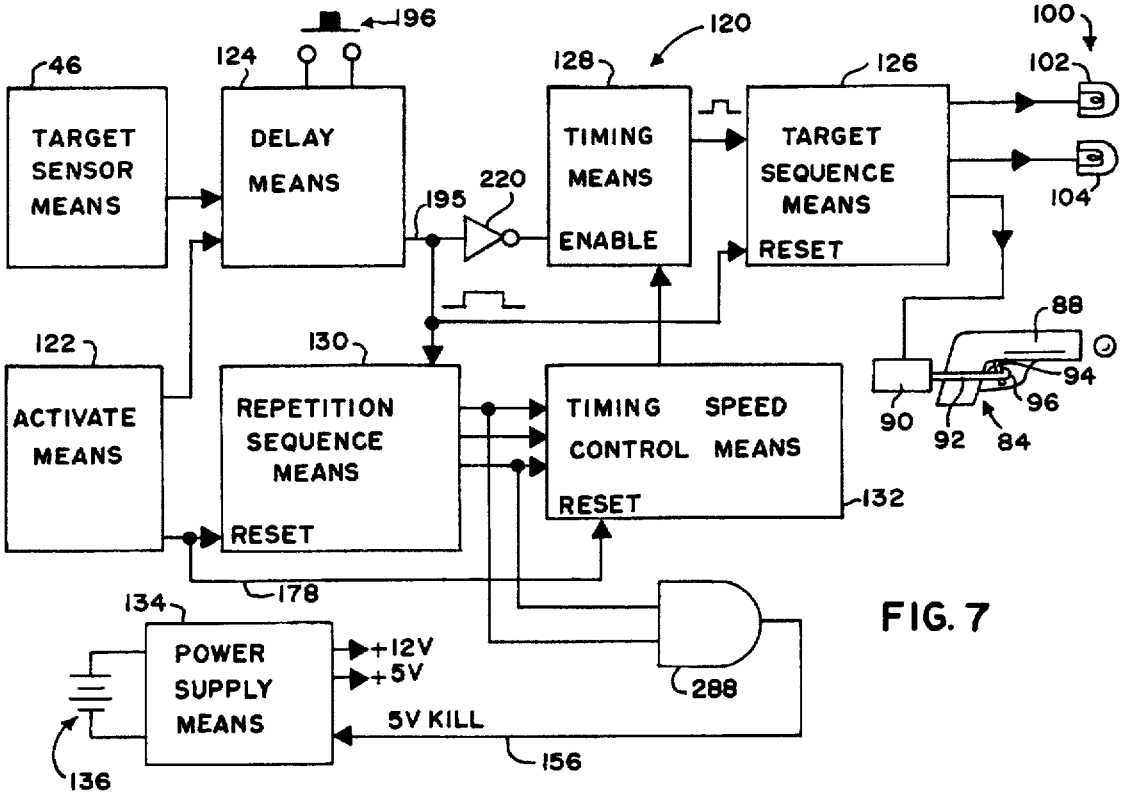
FIG. 7 is a block diagram of the electronic components of the control means of the present invention.

FIGS. 6 and 6A respectively show the front operator's panel 312 and a portion of the back operator's panel 314 for the control means 120 of the present invention, allowing the trainer-operator to control the operation of the apparatus of the present invention while testing a trainee-shooter. The various buttons, lights, and switches are described hereinabove.

To use the present invention, a trainee-shooter is instructed to stand approximately 21 feet (6.4 meters) in front of target 22 so as to protect the trainee-shooter from ricocheting bullet fragments. Cables 316 and 318 may be used to remotely connect control means 120 to target 22 at a safe distance therefrom. Initially, the power off switch 138 of control means 120 should be in the "off" position and the system active/inactive switch 168 should be in the "inactive" position. The trainer-operator turns the power to the unit on by moving switch 138 to the "on" position, and then verifies that the shooter is ready and that the firing range is clear. The operator then moves the system active/inactive switch 168 to the "active" position, thus starting the delay period of delay means 124. Control means 120 will then sequence through its various states and practice rounds until either firing means 84 fires a paint ball at the shooter (if the shooter does not successfully hit target plate 24 within the allotted time for a particular practice round) or else four successful rounds have been completed by the shooter, at which time the control means will disable itself by asserting the 5VKILL signal to shut down its 5 volt power supply. Within each round, the shooter, upon seeing the first (right) eye light after the initial delay period, should quickly draw and fire his or her weapon at target plate 24 before firing means 84 is actuated, thus causing control means 120 to advance to the next practice round with a faster pace of timing means 128. At the completion of four successful rounds by the shooter, the operator simply switches power switch 138 to the off position and active/inactive switch to the inactive position, thereby resetting control means 120 for another sequence of rounds with the same or another shooter. If the operator suspects that a shooter is becoming inattentive or that the shooter is beginning to anticipate the delay of delay means 124, the operator can occasionally suddenly and without warning depress delay abort button 198, thereby manually selectively and surprisingly terminating the initial delay of any given practice round, thus forcing shooters to remain alert. Additionally, if desired, the operator may vary the overall rate of timing means 128 by adjusting potentiometer 240 in a manner heretofore described, thereby varying the difficulty of a particular training session.

Although the present invention has been described and illustrated with respect to a preferred embodiment and a preferred use therefor, it is not to be so limited since modifications and changes can be made therein which are within the full intended scope of the invention.

We claim:

1. An apparatus for use in interactive target practice by a shooter firing bullets thereat, said apparatus comprising:

(a) a target, said target comprising:

i. a target plate;

ii. indicator means for indicating to the shooter that a practice round has begun;

iii. target sensor means for detecting when said target plate has been struck by a bullet fired by the shooter; and iv. firing means for firing a projectile at the shooter; and (b) control means for controlling the operation of said target, said control means comprising:

i. activate means for initiating a repetition series of said practice rounds;

ii. delay means, operably triggered by said activate means and by said target sensor means, for delaying the start of each said practice round by a given delay;

iii target sequence means for sequencing said target through a series of states for each practice round, said states comprising:

A. an initial state during said given delay;

B. a first intermediate state, following said initial state, indicating that said practice round has begun by actuating said indicator means; and C. a firing state, selectively following said first intermediate state, signifying that the shooter has not struck the target plate by a bullet during said practice round, said firing means being actuated by the occurrence of said firing state;

iv. timing means for causing said target sequence means to sequence through said series of states at a given rate after said given delay;

v. repetition series sequence means for counting said practice rounds; and vi. timing speed control means, operably coupled to said repetition series sequence means and responsive thereto, for changing said given rate of said timing means on successive practice rounds.

2. The apparatus as claimed in claim 1, in which said delay means additionally comprises delay abort means for manually selectively surprisingly terminating said given delay during any said practice round.

3. The apparatus as claimed in claim 1, in which said indicator means comprises a first indicator light and a second indicator light; said states of said target sequence means additionally comprise a second intermediate state following said first intermediate state and before said firing state, said second intermediate state signifying that said practice round is progressing and that said firing means will soon be actuated, said first indicator light being illuminated when said target sequence means is in said first intermediate state and said second indicator light being illuminated when said target sequence means is in said second intermediate state.

4. The apparatus as claimed in claim 3, in which said states of said target sequence means additionally comprise a third intermediate state, following said second intermediate state and before said firing state, signifying that said practice round is further progressing and is almost over, said first and said second indicator lights being illuminated when said target sequence means is in said third intermediate state.

5. The apparatus as claimed in claim 4, in which said target plate is shaped so as to resemble an upper body portion of a hostile opponent, and said first and second indicator lights are positioned on said target plate as said hostile opponent's left and right eyes.

6. The apparatus as claimed in claim 1, in which said target sensor means is a vibration sensor secured to said target plate.

7. The apparatus as claimed in claim 1, in which said target additionally comprises a target stand, said target plate being hingeably attached to said target stand for hinged movement away from the shooter, and said target additionally comprises shock absorbing means, operably interposed between said target stand and said target plate, for absorbing the impact energy of bullets striking said target plate.

8. The apparatus as claimed in claim 7, in which said target stand and said target plate are angled downwardly from vertical toward the shooter, said target stand including a deflection shield having left and right deflection plates, said left and right deflection plates being sidewardly angled so that impinging bullets are deflected sidewardly.

9. An apparatus for use in interactive target practice by a shooter firing bullets thereat, said apparatus comprising:

(a) a target, said target comprising:

i. a target stand;

ii. a target plate hingeably attached to said target stand for hinged movement away from the shooter, said target plate being shaped so as to resemble an upper body portion of a hostile opponent;

iii. shock absorbing means, operably interposed between said target stand and said target plate, for absorbing the impact energy of bullets striking said target plate;

iv. first and second indicator lights for indicating to the shooter that a practice round has begun, said first and second indicator lights being positioned on said target plate as said hostile opponent's eyes;

v. a vibration sensor secured to said target plate and sensing when said target plate has been struck by a bullet fired by the shooter; and vi. a paint ball gun for firing a paint ball at the shooter; and (b) control means for controlling the operation of said target, said control means comprising:

i. activate means for initiating a repetition series of said practice rounds;

ii. delay means, operably triggered by said activate means and by said target sensor means, for delaying the start of each said practice round by a given delay;

iii. target sequence means for sequencing said target through a series of states for each practice round, said states comprising:

A. an initial state during said given delay;

B. a first intermediate state, following said initial state, indicating that said practice round has begun by illuminating said first indicator light with said second indicator light being unilluminated;

C. a second intermediate state, following said first intermediate state, indicating that said practice round is progressing by illuminating said second indicator light with said first indicator light being unilluminated;

D. a third intermediate state, following said second intermediate state, indicated that said practice round is further progressing and is almost over by illuminating both said first and said second indicator lights; and E. a firing state, selectively following said first intermediate state, signifying that the shooter has not struck the target plate by a bullet during said practice round, said firing means being actuated by the occurrence of said firing state;

iv. timing means for causing said target sequence means to sequence through said series of states at a given rate after said given delay;

v. repetition series sequence means for counting said practice rounds; and timing speed control means, operably coupled to said repetition series sequence means and responsive thereto, for changing said given rate of said timing means on successive practice rounds.

10. The apparatus as claimed in claim 9, in which said target stand and said target plate are angled downwardly from vertical toward the shooter, said target stand including a deflection shield having left and right deflection plates, said left and right deflection plates being sidewardly angled so that impinging bullets are deflected sidewardly.

11. The apparatus as claimed in claim 9, in which said delay means additionally comprises delay abort means for manually selectively surprisingly terminating said given delay during any said practice round.

* * * * *